US009103232B1

(12) United States Patent
Hall et al.

(10) Patent No.: US 9,103,232 B1
(45) Date of Patent: Aug. 11, 2015

(54) STEAM CONDENSER

(71) Applicant: Joseph Hall, Glen Allen, VA (US)

(72) Inventors: Corey Hall, Alexandria, VA (US); Joseph Hall, Glen Allen, VA (US)

( * ) Notice: Subject to any disclaimer, the term of this patent is extended or adjusted under 35 U.S.C. 154(b) by 163 days.

(21) Appl. No.: 13/779,670

(22) Filed: Feb. 27, 2013

Related U.S. Application Data

(60) Provisional application No. 61/603,998, filed on Feb. 28, 2012.

(51) Int. Cl.

| | |
|---|---|
| ***F01K 13/00*** | (2006.01) |
| ***F01K 23/06*** | (2006.01) |
| ***F01K 11/00*** | (2006.01) |
| ***F28B 1/00*** | (2006.01) |

(52) U.S. Cl.
CPC .. *F01K 11/00* (2013.01); *F28B 1/00* (2013.01)

(58) Field of Classification Search
CPC ..... F28F 13/18; F28F 13/182; F28F 13/187; F28F 2245/02
USPC ..... 60/643–681
See application file for complete search history.

(56) References Cited

U.S. PATENT DOCUMENTS

| | | | |
|---|---|---|---|
| 4,419,187 | A | 12/1983 | Cheng et al. |
| 4,419,242 | A | 12/1983 | Cheng et al. |
| 4,470,268 | A | 9/1984 | Schilling |
| 4,476,024 | A | 10/1984 | Cheng |
| 4,527,956 | A | 7/1985 | Baumberg |
| 4,765,904 | A | 8/1988 | Kaplan |
| 5,725,049 | A | 3/1998 | Swanson et al. |
| 6,857,269 | B2 | 2/2005 | Baker |
| 7,313,926 | B2 | 1/2008 | Gurin |
| 8,099,958 | B2 | 1/2012 | Al-Mayahi et al. |
| 8,266,915 | B2 | 9/2012 | Saroka |
| 2002/0178723 | A1 | 12/2002 | Bronicki et al. |

FOREIGN PATENT DOCUMENTS

| | | |
|---|---|---|
| EP | 0094543 A2 | 11/1983 |
| EP | 0135419 A2 | 3/1985 |
| GB | 2441149 A | 2/2008 |
| GB | 2441149 B | 4/2011 |

OTHER PUBLICATIONS

Jan C. T. Eijkel and Albert Van Den Berg, Water in micro- and nanofluidics systems described using the water potential, The Royal Society of Chemistry Tutorial Review Lab Chip, Sep. 29, 2005, 8 pages.

Nor Aida Zubir and Ahmad Fauzi Ismail, Effect of sintering temperature on the morphology and mechanical properties of PTFE membranes as a base substrate for proton exchange membrane, Songklanakarin J. Sci. Technol., vol. 24 (Suppl.) 2002: Membrane Sci. & Tech., 9 pages.

*Primary Examiner* — Christopher Jetton

(57) ABSTRACT

An apparatus, system, and method for generating power including a boiler with a heat exchanger and an optional porous material at the heat exchanger. Further including an optional power-generating means that receives a vapor from the heat exchanger for generating power. Further including a condenser that receives the vapor from the heat exchanger. The condenser having a vapor chamber that receives the vapor, a porous material that receives the vapor, and a liquid chamber that receives a liquid condensed from the vapor. Further including an optional power-generating means that receives the liquid from the liquid chamber.

17 Claims, 4 Drawing Sheets

STEAM CONDENSER

CROSS-REFERENCE TO RELATED APPLICATION

This application claims the benefit of U.S. Provisional Application No. 61/603,998, filed Feb. 28, 2012.

FIELD OF THE INVENTION

The present invention relates generally to membranes. In particular, this invention pertains to apparatuses and systems having phase change at a membrane, and to methods of using such apparatuses and systems.

BACKGROUND

Steam power plants generate power by boiling high-pressure water to high-pressure steam in a boiler and sending the high-pressure steam into a steam turbine in which it expands. The expansion of the steam drives the steam turbine which provides power to a drive shaft generally used to power an electric generator. The steam exits the steam turbine as low-pressure steam but generally still contains most of the energy supplied by the boiler. Much of the energy of the low-pressure steam is lost in the steam condenser during the process of cooling the low-pressure steam to low-pressure water. The low-pressure water is pumped to high-pressure water before re-entering the boiler.

Energy conversion devices which have a convex meniscus are well known from the prior art. For example, EP 0 135 419 A2 to Kaplan, as shown in FIG. 4A through 4C, discloses a first container (30), a second container (32) separated from the first container (30), a working liquid (6, 10) disposed in said first and second containers in such a way that it has an open surface (8, 12) within each of the containers in communication with a vapor (16) of the working liquid, the working liquid vapor (16) being in communication with the open surfaces (8, 12) of the working liquid of each container (30, 32) and means for connecting the working liquids of the first (30) and second (32) containers to an external hydraulic circuit (28, 34, 36), wherein the working liquid in the first container (30) presents a convex meniscus surface (8) to the vapor (16) of working liquid in communication between the first (30) and second (32) containers, said convex meniscus (8) having a higher mean curvature than the average mean curvature of the open surface (12) of the working liquid disposed in the second container (32). The reference IEP 0 135 419 A2 to Kaplan and the corresponding reference U.S. Pat. No. 4,765,904 A to Kaplan are each incorporated by reference herein.

Another example of an energy conversion device having a convex meniscus is US 2010/0115977 A1 to Saroka, which discloses a device having working liquid disposed in a first container and a second container and a membrane creating convex menisci on an open surface of the working liquid disposed in the first container. The reference US 2010/0115977 A1 to Saroka and the corresponding reference GB 2 441 149 A to Saroka are each incorporated by reference herein. Another example of an energy conversion device is U.S. Pat. No. 4,470,268 A to Schilling, which discloses a boiler and condenser having a convex meniscus. The reference U.S. Pat. No. 4,470,268 A to Schilling is incorporated by reference herein. Another example of an energy conversion device is U.S. Pat. No. 6,857,269 B2 to Baker, which discloses a turbine and capillary action. The reference U.S. Pat. No. 6,857,269 B2 to Baker is incorporated by reference herein.

SUMMARY OF THE INVENTION

This disclosure is directed to using capillary action in a power plant to condense high or low pressure vapor to a higher pressure liquid through a porous material. By condensing vapor to liquid through the porous material a higher pressure is achieved which creates additional pressurized liquid. In an embodiment, the pressurized liquid can operate a hydraulic motor and/or offset some of the work necessary to pump the low-pressure liquid to a higher pressure before it re-enters the boiler. The capillary action can be formed in the boiler and/or the condenser. This disclosure would generate power in part by having a fluid phase-change through a porous material.

DETAILED DESCRIPTION

Figure 1:
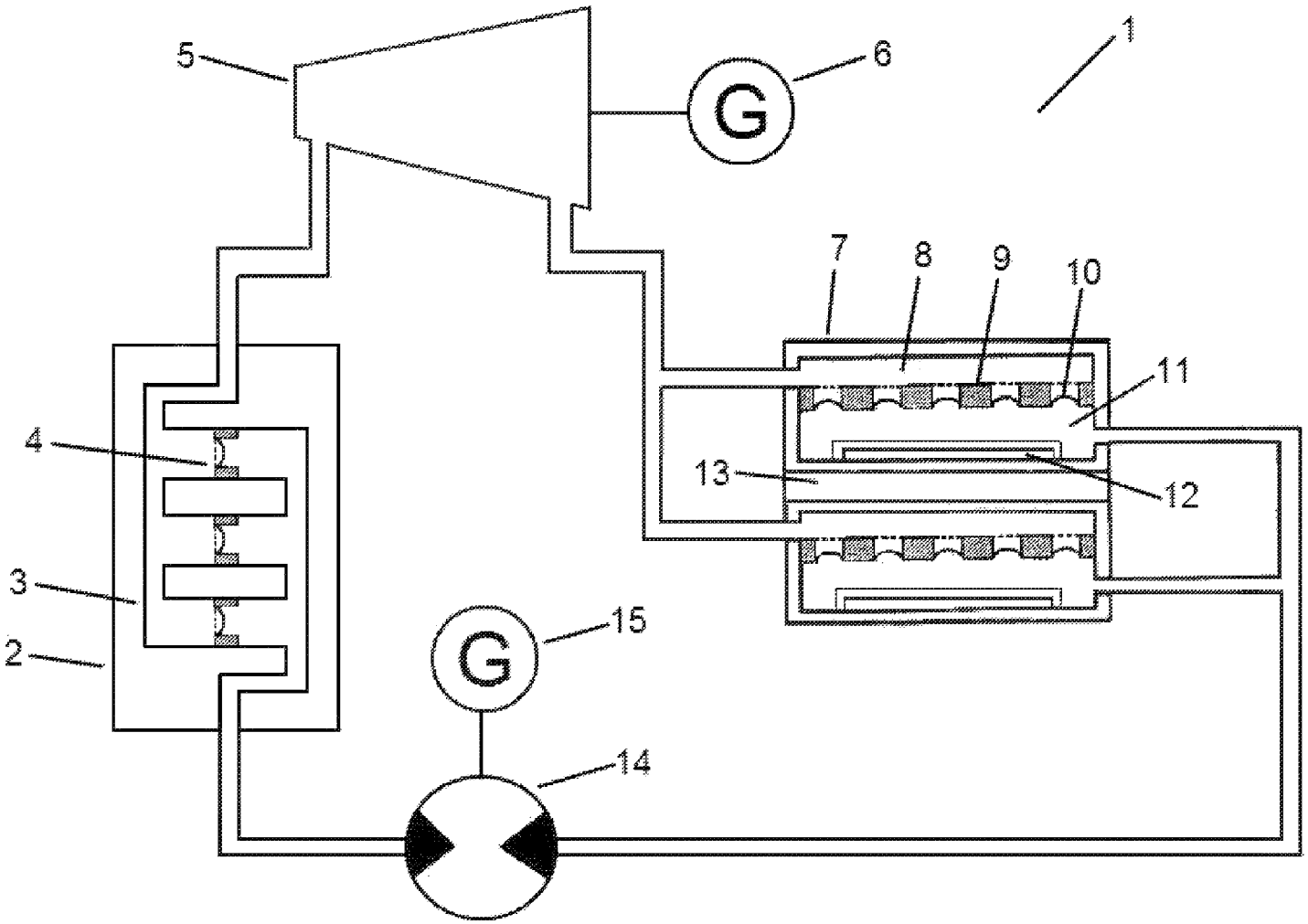
FIG. 1 shows a schematic representation of a power-generating system according to a first embodiment.

The first and preferred embodiment of the power-generating apparatus is shown in FIG. 1. FIG. 1 shows an apparatus (1), system (1), and method for its use for generating power comprising or consisting of or consisting essentially of a boiler (2) which may be heated from a source selected from the group consisting of coal, gas, biofuel, kerosene, oil, electric, solar, geothermal, waste or nuclear energy; a heat exchanger (3) at the boiler; an optional hydrophilic porous material (4) at the heat exchanger (3); an optional vapor turbine (5) or other means for receiving a vapor from the heat exchanger (3) and transmitting power; a generator (6) or other means for using the power transmitted from the vapor turbine (5) or other means; a condenser (7) receiving the vapor from the vapor turbine (5) or other means or the heat exchanger (3), the condenser (7) comprising or consisting of or consisting essentially of a vapor chamber (8) receiving the vapor, a hydrophobic porous material (9) for forming a convex meniscus (10) at a surface of a liquid, a liquid chamber (11) receiving the liquid, and a coolant chamber (12) or a coolant surface receiving coolant, or other means for cooling; an optional means for insulating (13) when condensers (7) are stacked; an optional hydraulic motor (14) and a generator (15) or other means for using the power transmitted from the hydraulic motor (14) or an optional pump; and the boiler (2) receiving the liquid.

Figure 2:
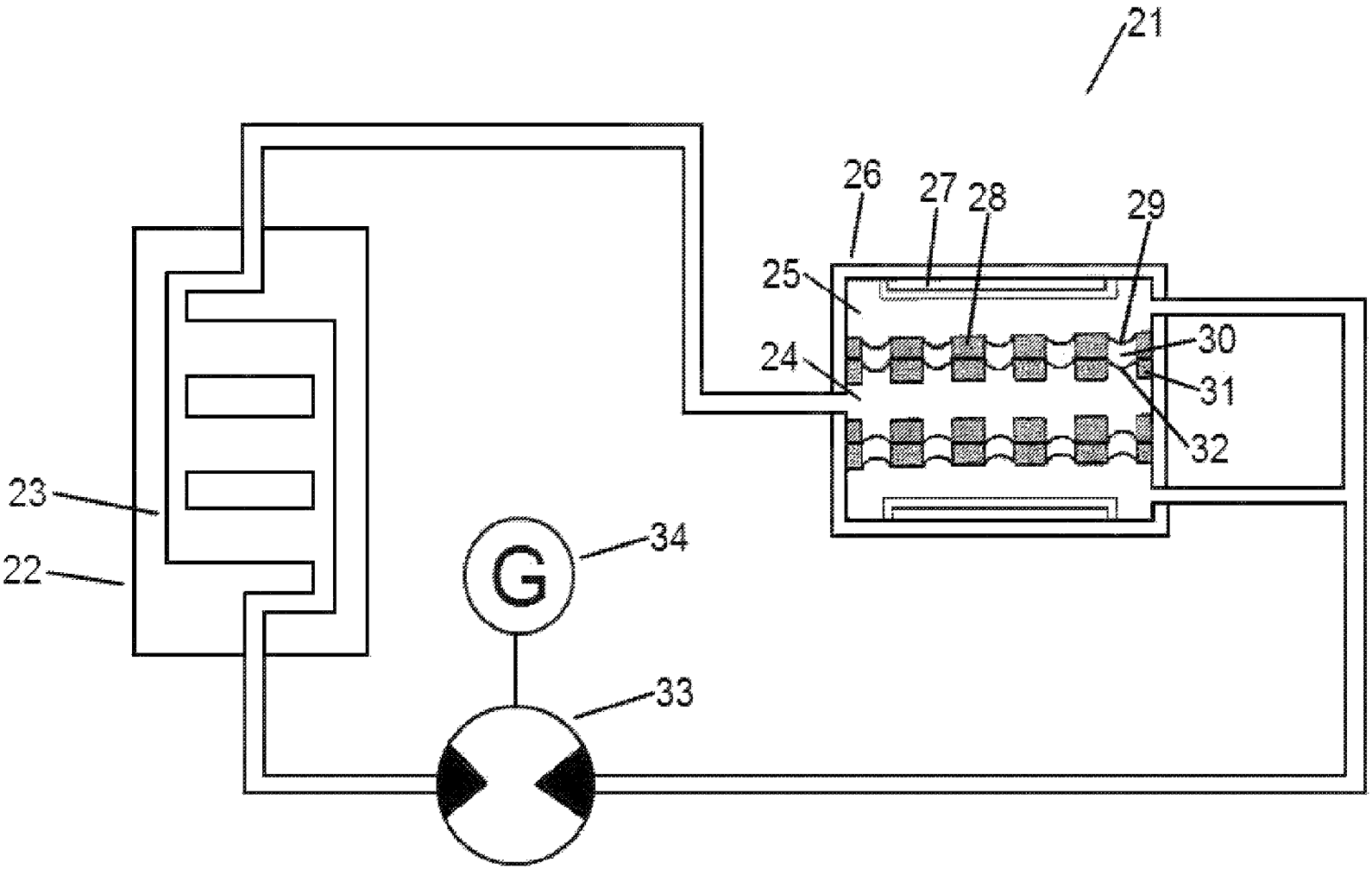
FIG. 2 shows a schematic representation of a power-generating system according to a second embodiment.

The second embodiment of the power-generating apparatus is shown in FIG. 2. FIG. 2 shows an apparatus (21), system (21), and method for its use for generating power comprising or consisting of or consisting essentially of a boiler (22) which may be heated from a source selected from the group consisting of coal, gas, biofuel, kerosene, oil, electric, solar, geothermal, waste or nuclear energy; a heat exchanger (23) at the boiler; a unit (26) receiving hot liquid from the heat exchanger (23), the unit (26) comprising or consisting of or consisting essentially of a hot liquid chamber (24) receiving the hot liquid, an optional hydrophilic porous material (31) receiving the hot liquid and forming a concave meniscus (32), a hydrophobic porous material (28) for forming a convex meniscus (29) at a surface of a condensate, a condensate chamber (25) receiving the condensate, and a coolant chamber (27) or a coolant surface receiving coolant, or other means for cooling; a hydraulic motor (33) and a generator (34) or other means for using the power transmitted from the hydraulic motor (33); and the boiler (22) receiving the condensate.

Figure 3:
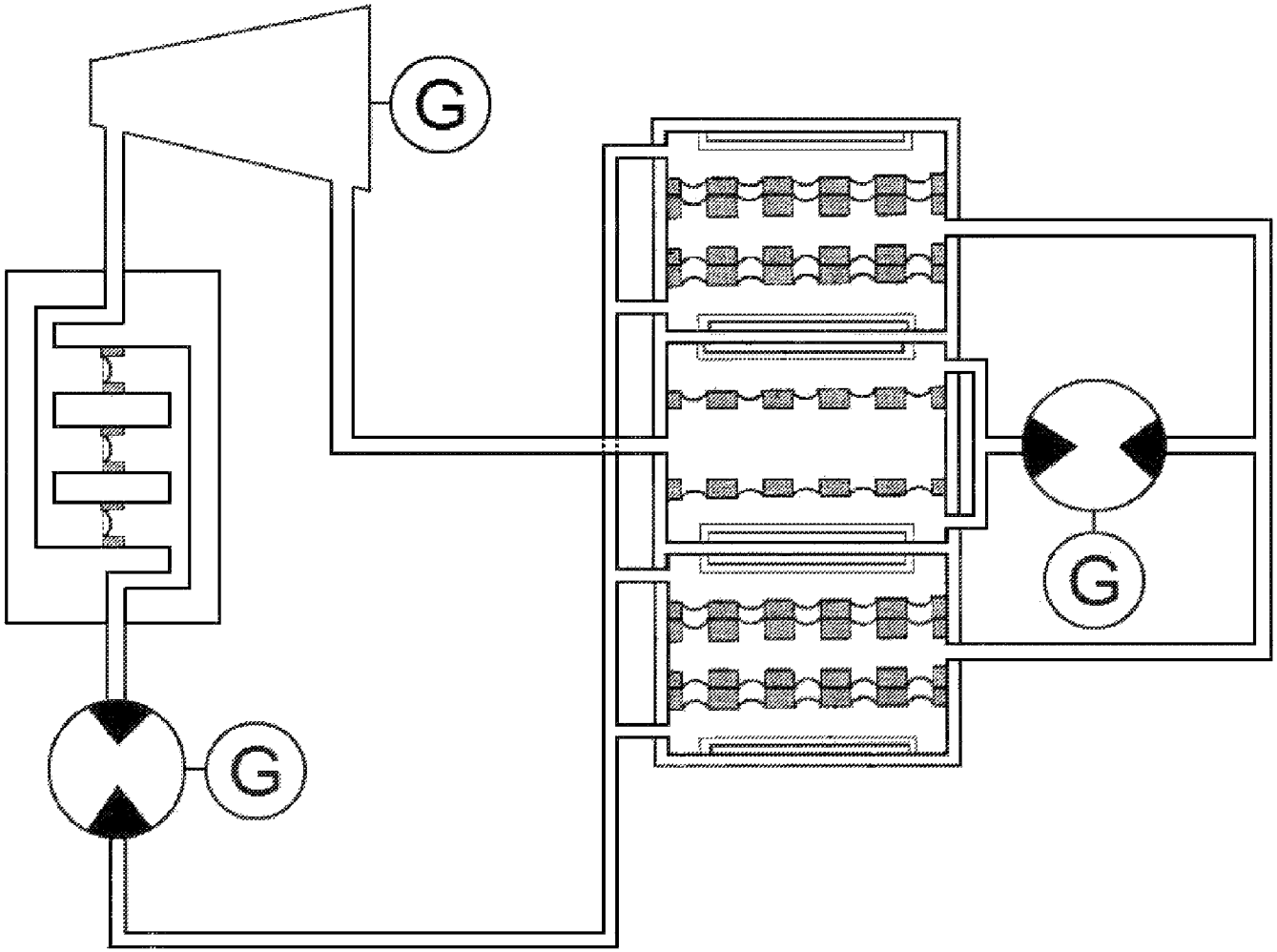
FIG. 3 shows a schematic representation of a power-generating system according to a third embodiment.
Figure 4B:
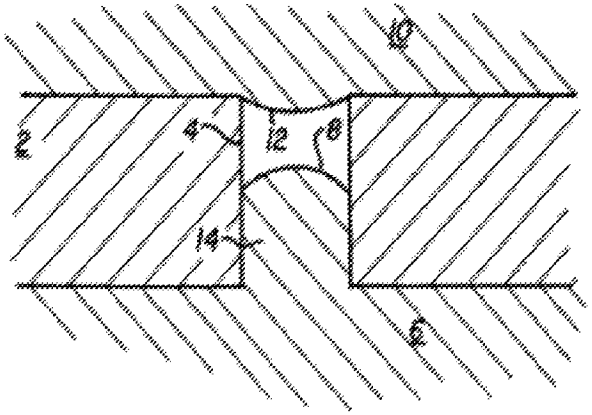
FIG. 4A-4C shows an energy conversion device of the prior art.
Figure 4C:
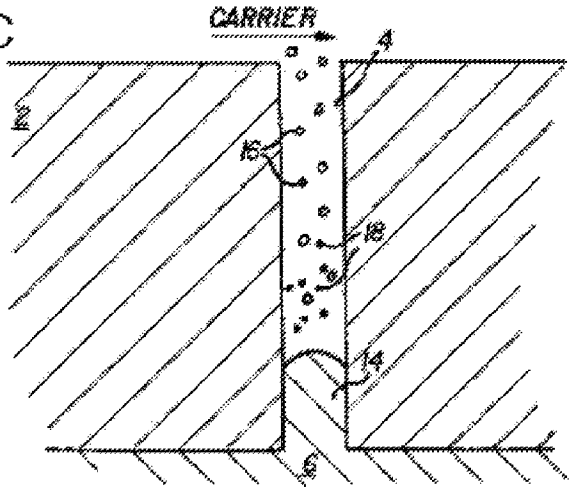
Fig. 4C Prior Art
Figure 4A:
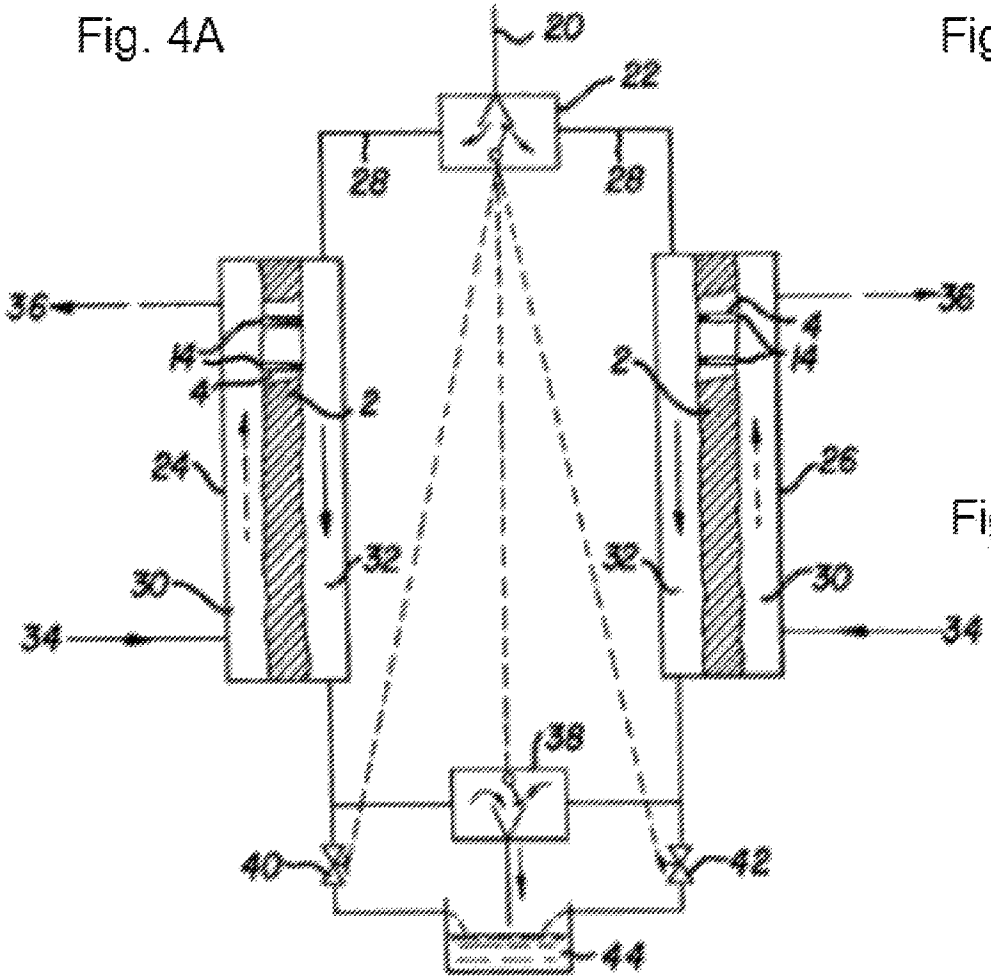

The third embodiment of the power generating apparatus is shown in FIG. 3. FIG. 3 shows a variation of the first and second embodiments, accordingly the reference numbers would correspond to like features. The combined embodiments are such that the water (steam or liquid) comes from the direction of the boiler, enters, crosses the hydrophobic porous material and then exits, passes through a hydraulic motor and then subsequently enters one or more units of the second embodiment each with a hydraulic motor and then returns to the boiler. The hydraulic motors may be linked to power one or more generators. The units might be stacked in heat exchange relationship or be reheated by coolant.

The solution provided herein can include a way to make a steam power plant design more efficient by including taking a supply of water fed through a hydraulic motor or pump to a wick where the water evaporates from the wick and by capillary action the water is pulled through the hydraulic motor or pump to replenish the wick with water. The solution provided herein can include a way to make a steam power plant design more efficient by including preserving the energy typically lost in the condensation phase of a steam power plant process and/or generating additional power from the condensing of the steam.

The invention could greatly improve coal plants in the United States. As of July, 2008, the average cost of coal supplied to existing coal plants in the United States was $2.09 per million BTU. At 34.3% efficiency for a typical coal plant, that translates to 2.08 cents per kilowatt hour for coal. Operation and maintenance is approximately 0.75 cents per kilowatt hour. Therefore, the total fuel and operating costs for a typical coal plant is 2.83 cents per kilowatt hour. Since the median age of existing coal plants is 44 years, most are already fully amortized. That means their owners have fully paid off the construction costs, and operating and fuel costs are the primary components of cost. Therefore, the steam power plant disclosed here could provide far greater profits, reduced pollution, and reduced rates for customers all while being applied to plants many of which have been fully paid off. These plants otherwise would not generally benefit from advances in the field with regard to efficiency but for this inventions ability to modify existing plants.

The modifying of power plants could include taking an existing plant or design which has tubes for boiling water and replace or modify the tubes with wicking heat pipe tubes.

Existing plants could be modified instead of having to build new plants (avoiding the massive costs of finding a site, getting zoning, community resistance, a workforce, and builders because this system can be a modification). The existing tubes can be modified by cutting the existing tubes and welding in the heat pipes disclosed herein. The existing tubes can also be modified by coating the interior of the tubes with a material, such as the metal used to make sintered metal wicks.

There has been a massive long felt need to make these plants more efficient. In particular with regard to the amount of energy lost in the condensing section. A source of steam for the convex wick would be the steam leaving the steam turbine which is frequently near the condensation point and is generally simply cooled using water from a body of water, such as a river, with a significant waste of energy. For example, in a steam power plant an amount of energy Q is provided by the boiler. The steam turbine generates shaft power by allowing the high-pressure and high-temperature steam to expand to low-pressure and low-temperature steam. The shaft power produced can be 8 MW. The steam pressure drops to 20 kPa and has a much lower temperature of about 60 degrees C. In order to recirculate the steam to the boiler for use again it must first be condensed and at about 3 psi the steam is no longer efficiently useable to generate power from a turbine. The condenser receives coolant which can be water from a river to condense the steam. In this process Q water (steam at 0.9 or 90% quality) transfers to Q condenser (coolant) at the amount of 17.6 MW. Thus about two thirds of the energy in the steam is not used to produce power. However, with this disclosure, the condenser would have a hydrophobic porous material which the steam enters and then condenses within the pores. This creates a flow of water into a convex surface of the condensed water resulting in a higher pressure flow of condensed water out of the condenser. Greater overall efficiency is achieved by converting Q of steam into a flow of water used for powering the system which is some portion of the 14.1 MW of power typically lost during the condensing of the steam. Thus the power achieved could be significantly greater than that which steam power plants are currently achieving.

It may be easier for one to visualize aspects of this disclosure if they are explained by bringing the principles down to the molecular level. The functioning of the condenser can be described in the following way: a molecule of water having been heated to steam enters the vapor chamber of the condenser through an inlet. The vapor chamber includes a ceiling above the hydrophobic porous material. The water molecule moving at a high speed will bounce off of surfaces and other water molecules. At some point the water molecule zips downward into a pore of the hydrophobic porous material. The water molecule continues down the pore until it goes kerplunk into the convex surface of the condensed water in the pore. As the water molecule impacts on the other water molecules of condensed water some energy is transferred to those other water molecules. This water molecule gets stuck under the convex surface and is now part of the water molecules of condensed water. Because the volume of the liquid chamber is fixed and is already filled to capacity with water molecules, the addition of this extra water molecule means that another water molecule must leave the liquid chamber. The convex surface of the condensed water places those water molecules under high pressure and the water molecules transfer this high pressure to the other water molecules such that they are all under the same high pressure. Thus the water molecule that leaves is also under high pressure. The addition of the water molecule also generates heat or put another way makes the other water molecules which are moving slowly move a little faster. In order to prevent the reaching of an equilibrium point where for each water molecule that is added to the convex surface another water molecule leaves the convex surface (i.e. a water molecule would not be forced to leave the liquid chamber through the outlet because a water molecule just left through the convex surface) because the condensed water molecules have been made to move faster with each additional water molecule, we must remove heat energy or in other words slow those water molecules back down. This is done by passing a coolant through a heat exchanger that takes away some of the energy of the water molecules of the condensed water. Eventually the water molecule that was added through the convex surface will itself be forced to leave the liquid chamber by the addition of another water molecule. It is this movement of water molecules down into the convex surface that generates a flow of water under high pressure out of the liquid chamber. While some of the energy of the steam will still be lost to the coolant, much of this energy will be converted to energy stored as high pressure water flow. This high pressure water flow can, for example, be channeled through a hydraulic motor to do work such as generating electricity.

Saroka states that eighty percent (80%) of the energy of the steam can be captured. At the nanometer scale for pores the pressure can be upward of 29.6 MPa and up to 74 MPa. These high pressures can do work on a hydraulic motor such that some of the potential energy of the tightly packed water molecules is converted to kinetic energy of the hydraulic motor. If some percentage of the energy that would otherwise have been lost to the condenser in a regular steam power plant is captured by the condenser disclosed here in the form of high pressure water and passed through a hydraulic motor of eighty-seven percent (87%) efficiency then a substantial amount of energy wasted during the condensing step of a steam power plant can be captured and made available for powering an electric generator or for other purposes. It may be desirable to maximize the use of the hydraulic motor over a steam turbine due to the greater efficiency of the hydraulic motor. One might even eliminate the steam turbine entirely. By further including a hydrophilic porous material in the heat exchanger of the boiler one can further increase the pressure drop across the hydraulic motor. It may also be desirable to have essentially zero pressure-drop between the boiler and condenser (i.e. no steam turbine). Optimization would be used to decide which configuration is most desired for the particular application.

Could also have a layered setup where hot water from a boiler enters a chamber, the hot water comes in contact with a porous material which could be hydrophobic or hydrophilic. On opposite side is a layer of hydrophobic porous material that creates convex meniscus. This side is the condensate side. The hot water, for example, comes in contact with a hydrophilic porous material creating a concave meniscus at the surface of which the water will evaporate. There could also be interposed between these materials a porous material for structural support, spacing and to provide a pathway without requiring the pores be aligned. One could also have a hydrophobic material having larger pores (therefore less of a convex surface) attached to another hydrophobic material having smaller pores (therefore more of a convex surface which would be on the condensing side) to generate flow. The pore sizes and materials might be consistent or different through each layer. The pores can have an average or mean pore diameter size of less than 500 nanometers or less than 100 nanometers or less than 10 nanometers. The pores can also have an average or mean pore diameter size equal to or greater than 500 nanometers and could be sized other than nanometer and could be micrometer or larger and the working liquid could be other than water, for example mercury. The membrane could have both hydrophobic and hydrophilic sections or one or the other. By having the water directly contacting the materials we minimize to the greatest degree the distance the water molecules in vapor form have to travel. This maximizes flow across the materials for greater flow per surface area. By having convex and concave surfaces the pressure differential is maximized. The supply pipe supplying to the condenser can have a cross sectional area ⅕-1/20 the average cross sectional area of the hydrophobic porous material. The supply pipe supplying the vapor to the condenser can have a cross sectional area less than ⅕ the average cross sectional area of the hydrophobic porous material. The ratio could be less or greater than these. In some embodiments, the boiler can operate to heat but not boil water. The hot water is fed to the units which create a pressure increase and flow of water that powers a hydraulic motor. The pressure in the old plant could be rather low which could be of great benefit where pipes may be fatigued from decades of service under high pressure and temperature.

There are an abundance of variations in which the systems disclosed herein could be applied, such as a means of propulsion in a nuclear, or normuclear, ship or submarine. The coolant surface could be the hull of a ship or submarine, which because it is in direct contact with water inherently provides a large surface area for heat exchange for condensing at the convex wicking section. The disclosure includes an aftermarket modification where heat exchange plates can be welded onto the hull. Further there could be various means by which this system could be insulated to optimize heat or energy preservation including using a gas or vacuum space, aerogel, foam, fiberglass, plastic, rubber, wood or other materials. The condenser could further include a stirrer to move condensed water heated from the condensing of steam toward the coolant section and to move condensed water cooled by the coolant section toward the hydrophobic porous material. The membranes could also include structures such as braided membranes or other static mixers that cause or increase turbulence to improve evaporation or condensation as desired. Heat exchanging fins could also be added to increase the rate of evaporation or condensation. There could be fins extending from the coolant section to better absorb the heat from condensate. The fins could be shaped so that as condensate flows out of the condenser turbulence or mixing is caused. The fins might be in contact with the hydrophobic porous material directly or indirectly through some other support for the material.

The systems disclosed herein could be modified to be completely separate structures from the source of the vapor, or even a portable system that could tap into existing systems using conduit or piping to carry vapor to the system from a remote location. This system could be used to replace the cooling tower of a steam power plant or incorporated into the cooling tower to maximize efficiencies. There could obviously be numerous valves to control flow in particular for embodiments wherein the flow of steam can optionally be directed to the steam turbine or directly to the condenser or wherein flow from the condenser goes through a hydraulic motor or directly to the heat exchanger but not limited thereto. The distance between the boiler and condenser can be very large including more than several inches or more than several feet or more than hundreds of feet or more. The meniscus shown can represent a plurality of meniscus or menisci. The pores could be of a wide variety of sizes and shapes.

An embodiment includes specifically excluding having the evaporation occur directly above or directly below the convex wicking member and condensing sections. Another embodiment specifically excludes a hydraulic pump or hydraulic motor between the condenser and boiler for improved efficiency. Not having the condenser and boiler directly above or below each other solves the problem where heat transfers through the housing which may otherwise need to be addressed by having insulation. By moving the heat source away from the cooling section we reduce heat loss directly from the heat source to the cooling source.

The system could use a variety of shapes including the use of square or circular tube members for creating convex surfaces. This could be inside or outside of another tube. For example, an inner tube carrying cooling water and an outer tube member which has condensed water from steam. Outside thereof could be steam inside a chamber. This configuration may provide a structure that allows easier conforming to the shape of cooling towers. Further, increased surface area with increased strength may be achieved by making the system tubular as opposed to flat.

The disclosure further includes using microwaves and/or induction to provide heating at the membranes. It is known from membrane distillation that the pores commonly become clogged or wetted with condensate stalling the flow across the membrane. Essentially condensation occurs in the pores and this wetting stops flow through the pores. In order to further prevent this clogging, radio frequency (RF) waves which can include microwaves, and/or induction heating (which may include coating the membrane with inductive material or particles or making the membrane of inductive material and coating it with hydrophobic material) may be used to evaporate condensate from the membrane. The heating, particularly with microwaves and RF can be used to scavenge condensate that collects at the membranes. RF and microwaves can efficiently prevent condensation because they can heat any condensate on the vapor side or within the pores back to vapor by causing reversing polarity which can make water molecules rub against each other. The friction heats them up to evaporate. Molecules in vapor form can freely spin without rubbing and so will not absorb much of the energy of the microwaves. The RF waves and microwaves can be applied at any location throughout the system where a reduction in condensation is desired, for example at the turbine or conduits or chambers carrying vapor. The RF generator may be located at the membrane or the vapor chamber or any other location in the system. The RF waves or microwaves could be channeled into the membrane from the side by having mesh layers on the front and/or back of the membrane or by having layers of metal on the membranes (perhaps inductive or non-inductive) and may be applied by vapor deposition. This will make the microwaves travel at the membrane. The membrane could also itself form a waveguide and carry the waves even without mesh or metal coatings. The membranes could be or include slab waveguides and/or dielectric waveguides and/or slab dielectric waveguides. Membranes for capillary action could be directly heated or cooled. The membranes could have electric heating elements attached or embedded to them. The membranes could have conduits for heating or cooling liquid attached or embedded and might allow for switching between heating and cooling. The heating of the liquid or vapor directly at the membrane can reduce the impact of thermal conductivity across the membrane because the liquid or vapor on the evaporating side of the membrane can be at a lower temperature up to the point when the water molecules are heated at the membrane. The liquid could be the same temperature on both sides of the membrane and still have vapor diffusion across the membrane by heating the liquid or vapor on the evaporation side of the membrane at the membrane. The variations disclosed herein are generic to all embodiments disclosed herein.

The combination of hydrophobic and hydrophilic layers not only helps with changes in pressure but can also help locate the meniscus which when heating the concave meniscus by external heating means can be of great importance. The external heating means could be for example induction or microwaves or some other means for heating over a distance. In particular microwaves provide a way to heat the liquid at the meniscus essentially from the inside out whereas the other means for heating are generally from the outside in (such as heating from the walls of the pores using copper heated by induction). Microwaves could be funneled into a thin line of waves aligned with the meniscus. In particular, the membranes could serve as waveguides for receiving RF (which could include microwaves) and directing that toward the pores of the membranes.

The system could have hydrophilic and hydrophobic porous material layers where a layer is heated by induction heating. For example, a layer of sintered copper (of course it could be other materials and forms) pulls water into its pores. This water can then be heated by the sintered copper by induction. The vapor would then travel through the pores and into the hydrophobic porous material. The vapor is then absorbed into condensate at the hydrophobic material generating a flow. The hydrophobic porous material could be formed by coating the inductive membrane with hydrophobic material. This could provide a very efficient way to provide a flow of water without the use of a pump powered by an electric motor while still generating a flow of water using an electric source of energy. Would be very quiet, and largely without vibration. It could also achieve extremely high pressures. It might have a few layers, for example a ferromagnetic layer or glass layer or other non-induction heated layer of hydrophilic porous material, then a layer of induction heatable hydrophilic porous material which could be extremely thin, and then a layer of hydrophobic porous material. The system could provide for a high pressure pump with a low likelihood of failure. Heating of metal layer could be by circulating a heating fluid through a conduit grid in contact with the metal layer. The system could also be used to power a heat pump. The copper or other material might make the hydrophilic porous material or might coat another material by for example vapor deposition or be in a solution such that it contacts the material and is absorbed onto it. The heat energy for evaporation could be entirely or only partially from induction or RF. The heat energy could also be from nuclear energy such as that found in nuclear power plants or could be from nuclear material which could include nuclear waste that is located at the membrane. The nuclear material could be deposited onto or into the membrane or could form the membrane itself. So induction or RF could be used at a boiler section or at the unit. The material might be placed on a vapor side of hydrophobic porous material with or without other hydrophilic porous material. It could also extend into pores to more directly provide heating. It might also be only located in the pores.

The membranes could further include internal power generators such as water turbines or other types of hydraulic motors located internal of the first and second containers or the vapor chamber and the liquid chamber or the hot liquid chamber and the condensate chamber and could pass through the membrane to avoid the need for an external hydraulic circuit. This configuration can optionally exclude an external hydraulic circuit or an external boiler, hydraulic motor or vapor turbine either completely or by valves. This configuration can specifically exclude any hydraulic circuit, boiler, hydraulic pumps, hydraulic motors, or vapor turbines from being attached to the chambers. Thus, this configuration can provide a completely self-enclosed system at least with regard to the flow of vapor or liquid. This configuration improves efficiency because energy not converted by the hydraulic motor to mechanical output can be transmitted at least in part back to the liquid or vapor that is to pass through the membrane and condense. This configuration could generate electricity or have an output shaft, it might also use pistons or other means for capturing the energy of the flow across the membranes. The hydraulic motor can be within three inches of or within half an inch of or within a quarter of an inch of or in direct contact with the membrane to reduce energy losses and to minimize the weight and space of the system.

The system can also provide an electric motor by using heating (e.g. induction or RF) to cause vaporization and the convex meniscus to generate high pressure flow. The high pressure flow can be used to drive a hydraulic motor, the shaft of which will provide an output similar to that of an electric motor.

The system disclosed herein can also be used for membrane distillation to provide for fresh water and/or a purified liquid. For example, the evaporating and/or scavenging of the condensate can be achieved using induction and/or RF (which could include microwaves). The hydrophobic membrane can be modified in the ways described herein to allow for improved membrane distillation. The system disclosed herein can also be used for distillation, for example, alcohol from water. It could also be used for many chemical and biological processing.

While this disclosure frequently discloses using steam and water it is within the scope of the disclosure that the working fluid could be something other than water. For example a refrigerant or mercury, but not limited thereto. It would be obvious to try different working fluids, including combinations of fluids to achieve temperature glide, as they will have different evaporation points at different operating conditions such that through optimization one would be expected to find that some working fluids provide advantages such as lower energy for phase change or lower or higher pressure and temperature operating conditions desired for a particular application. The disclosure includes comprising, consisting and consisting essentially of. The disclosure further includes an apparatus, system and method. A hydraulic motor could be used to drive the drive shaft of the propeller of a vessel or submarine or provide propulsion for vehicles. The system could be used in any application where a rotating shaft is used to do work. Now that we have provided this disclosure, it would be obvious to combine it with other steam power plants as well as other applications.

The membranes could be of any type of material and shape capable of providing the convex or concave meniscus of the working fluid as needed for the particular section it is to be used for. The membrane could be made of any type of hydrophobic material or combination of materials. The hydrophobic materials could include Teflon, polytetrafluorethylene (PTFE), polypropylene (PP) or polyvinylidene fluoride (PVDF) or hydrophobic aerogel. It would be obvious to try any known technique for forming a porous material in order to optimize this disclosure. The terms hydrophobic and hydrophilic do not limit that which is being disclosed to water but are rather terms being used to convey that at the liquid-vapor interface the material will create a convex or concave meniscus. The system can have as many wide or stacked condensing sections as are needed. The term "at" as used herein is defined as in, on or near. The system could have a u-shaped zigzag configuration so that two vapor chambers are adjacent each other and then two liquid sections are adjacent each other.

The disclosure is not intended to be limiting and is limited only by the claims. Furthermore, in view of this disclosure it would be obvious to combine what has been disclosed here with other devices, systems, apparatuses, and methods.

The invention claimed is:

1. A system for generating power comprising:

a boiler heated from a source selected from the group consisting of coal, gas, biofuel, kerosene, waste, oil, electric, solar, geothermal, or nuclear energy;

a heat exchanger at the boiler for generating a vapor;

a vapor turbine receiving the vapor from the heat exchanger and transmitting power;

a condenser receiving the vapor from the vapor turbine, the condenser comprising a vapor chamber receiving the vapor, a hydrophobic porous material for forming a convex meniscus at a surface of a liquid, wherein the hydrophobic porous material is shaped as a flat surface or as a tube, wherein the hydrophobic porous material has an average pore diameter size of less than 500 nanometers at the surface of the liquid, a liquid chamber receiving the liquid condensed from the vapor, and a coolant chamber or a coolant surface receiving coolant;

a supply pipe supplying the vapor to the condenser and comprising a cross sectional area less than ⅕ the average cross sectional area of the hydrophobic porous material;

a radio frequency generator which creates radio frequency waves at the hydrophobic porous material or an induction heating generator which creates a current through an inductive material at the hydrophobic porous material to reduce wetting at the hydrophobic porous material; and a hydraulic motor receiving liquid passing from the condenser to the boiler;

wherein the boiler and the condenser are more than several feet apart;

wherein evaporation at the boiler does not occur directly above or directly below the hydrophobic porous material.

2. A method for generating power comprising:

producing a vapor in a boiler heated from a source selected from the group consisting of coal, gas, biofuel, kerosene, waste, oil, electric, solar, geothermal, or nuclear energy;

expanding the vapor through a vapor turbine to generate power and transmitting the power;

condensing the vapor from the vapor turbine in a condenser, the condenser comprising a vapor chamber receiving the vapor, a hydrophobic porous material for forming a convex meniscus at a surface of a liquid, a liquid chamber receiving the liquid, and a coolant chamber or a coolant surface receiving coolant;

passing the condensed liquid from the condenser through a hydraulic motor before returning to the boiler.

3. A system for generating power comprising:

a boiler heated from a source selected from the group consisting of coal, gas, biofuel, kerosene, waste, oil, electric, solar, geothermal, or nuclear energy;

a heat exchanger at the boiler;

a vapor turbine receiving a vapor from the heat exchanger and transmitting power;

a condenser receiving the vapor from the vapor turbine, the condenser comprising a vapor chamber receiving the vapor, a hydrophobic porous material for forming a convex meniscus at a surface of a liquid, a liquid chamber receiving the liquid, and a coolant chamber or a coolant surface receiving coolant; and a hydraulic motor receiving liquid passing from the condenser to the boiler.

4. The system of claim 3, further comprising a generator or a propulsion system of a submarine or a ship receiving power from the vapor turbine.

5. The system of claim 3, wherein the coolant surface is the hull of a submarine or a ship.

6. The system of claim 3, the condenser further comprising an insulating layer.

7. The system of claim 3, wherein the condenser comprises the hydrophobic porous material shaped as a tube.

8. The system of claim 3, further comprising a cooling tower of a steam power plant supplying coolant to the condenser.

9. The system of claim 3, further comprising a heat exchanger supplying coolant to the condenser to condense the vapor to a liquid.

10. The system of claim 3, wherein the boiler is an existing boiler in a power plant.

11. The system of claim 3, further comprising a hydrophilic porous material at the heat exchanger.

12. The system of claim 3, wherein the hydrophobic porous material further includes a hydrophilic porous material.

13. The system of claim 3, further comprising a supply pipe supplying the vapor to the condenser having a cross sectional area less than ⅕ the cross sectional area of the hydrophobic porous material.

14. The system of claim 3, wherein the boiler and the condenser are more than several feet apart.

15. The system of claim 3, wherein the evaporation at the boiler does not occur directly above or directly below the hydrophobic porous material at the condenser.

16. The system of claim 3 wherein the vapor passes through the vapor turbine and the liquid passes through the hydraulic motor between the boiler and the condenser.

17. The system of claim 3, further comprising a radio frequency generator which creates radio frequency waves at the hydrophobic porous material or an induction heating generator which creates a current through an inductive material at the hydrophobic porous material to reduce wetting at the hydrophobic porous material.

* * * * *